United States Patent [19]

Boccarossa et al.

[11] 3,952,629

[45] Apr. 27, 1976

[54] SMALL ARMS SILENCER

[75] Inventors: Jack Boccarossa, Rock Island County, Ill.; John S. Post, Scott County, Iowa

[73] Assignee: The United States of America as represented by the Secretary of the Army, Washington, D.C.

[22] Filed: Feb. 13, 1975

[21] Appl. No.: 549,575

[52] U.S. Cl. ..... 89/14 D

[51] Int. Cl.[2] ..... F41C 21/18

[58] Field of Search ..... 89/14 R, 14 B, 14 C, 89/14 D; 181/64 B

[56] References Cited

UNITED STATES PATENTS 880,386 2/1908 Maxim ..... 89/14 D

*Primary Examiner*—Stephen C. Bentley

*Attorney, Agent, or Firm*—Nathan Edelberg; Robert P. Gibson; Max Yarmovsky

[57] ABSTRACT

A small arms silencer utilizes a transversely perforated biased piston member, moving in a vented, perforated, housing, to temporarily contain projectile blast gases in a sealed-off area. The trapped noise producing blast gases are released through a valve in the housing at a rate and frequency which makes the blast noise level inaudible. Barrel movement compensation is provided by a combination of an impulse of gases acting against a closed end of the housing in opposition to a counter force generated by the moving piston on the other end of the housing.

4 Claims, 1 Drawing Figure

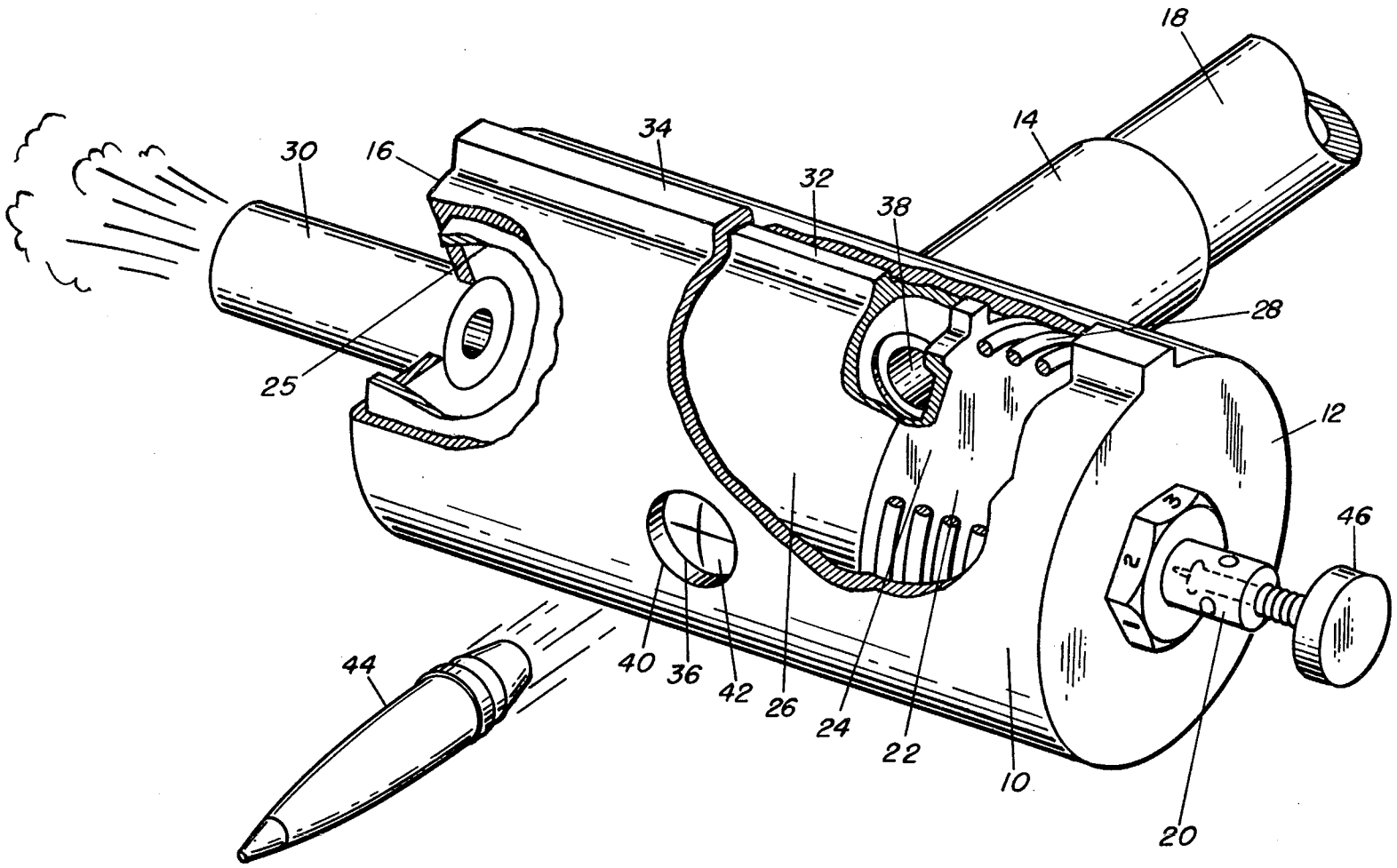
18
14
28
12
46
20
10
22
24
26
38
32
34
42
36
40
16
30
25
44

SMALL ARMS SILENCER

GOVERNMENTAL INTEREST

The invention described herein may be manufactured, used and licensed by or for the Government for governmental purposes without the payment to me of any royalty thereon.

BACKGROUND OF THE INVENTION

Various means have been used in prior art small arm silencers to attenuate muzzle blast noise, reduce barrel compensation and muzzle flash. The problem with prior art devices which use baffles or choke tubes to deflect and break up the shock wave has been that the level of noise attenuation was generally of a low order. In addition the use of baffles or choke tubes generally did nothing to provide for muzzle compensation. Those prior art devices which use taper slots or grooves in a housing to ventilate the propellant gases as they leave the muzzle and to break up the symmetrical configuration of the shock wave, are generally inefficient in noise reduction, do not completely prevent the gun flash from being seen, and do not provide adequate barrel compensation.

SUMMARY OF THE INVENTION

The present invention relates to a small arms silencer which utilizes a perforated piston-housing combination to allow a projectile as it exits from the muzzle to freely pass through the housing and the piston while restricting the gases behind the projectile. The restricted gases are forced to temporarily remain in the housing. The expanding gases move the piston within the housing which then closes off a hole in the piston wall which was initially concentric to an exit opening in the housing. When the exit to the housing is sealed, the sealed residual muzzle blast gases are bled off at a controlled rate through a valve which reduces the blast noise by changing the gases exiting frequency to an inaudible range. A split neoprene restrictor located in the projectile exiting hole in the housing prevents the initial blast gas flash from being observed. The impulse of gases acting against the end of the housing and against the piston acts as a barrel compensator to improve the firing accuracy of the weapon and in addition provides for quick response to target re-engagement.

An object of the present invention is to provide a small arms silencer which attenuates muzzle blast noise.

Another object of the present invention is to provide a small arms silencer which attenuates muzzle blast noise and compensates for barrel movement caused by muzzle blast gases.

Another object of the present invention is to provide a small arms silencer which attenuates muzzle blast noise, compensates for barrel movement caused by muzzle blast gases and reduces the amount of muzzle flash.

A further object of the present invention is to provide a combined small arms silencer barrel compensator and flash suppressor which is inexpensive to manufacture.

For a better understanding of the present invention, together with other and further objects thereof, reference is made to the following descriptions taken in connection with the accompanying drawings.

BRIEF DESCRIPTION OF THE DRAWING

The sketch shows a partial cutaway isometric view of a small arm silencer attached to a barrel muzzle.

DETAILED DESCRIPTION OF THE PREFERRED EMBODIMENTS

Referring now to the sketch a "T" shaped, cylindrically shaped hollow housing 10 has a partially closed front end 12, a partially closed rear end 16 and a middle tubular muzzle connection member 14. Fixedly attached to the front end 12 is an adjustable needle type relief valve. A muzzle barrel 18 is slidably fixed to muzzle connection member 14. Relief valve 20 which is connected to front end 12 permits air to enter into or escape from the front volume 22 at a controlled rate. Volume 22 is located in the housing 10 intermediate the closed end 24 of cylindrical piston member 26 and the front end 12 of housing 10. Piston 26 has an open end 25 which abuts housing rear end 16. A helically shaped piston return spring 28 is biasedly positioned in volume 22 intermediate piston closed end 24 and housing front end 12. The housing rear end 16 has a blast gas release valve 30 fixedly attached thereto which bleeds off blast gases at a controlled rate and frequency which is inaudible. A valve for releasing gas at frequencies from 15,000 to 30,000 cycles/second such as used and manufactured by La Pine Scientific Co., 6001 South Knox Avenue, Chicago, Illinois, 60629, Catalogue No. Y-41270. Piston 26 has a longitudinally positioned alignment key 32 thereon which slidably engages a longitudinally positioned housing keyway groove member 34. When piston 26 is in an "open", "pass-through" position two transverse diametrically positioned piston orifices 36 and 38 are in axial alignment with housing exit orifice 40 and muzzle barrel 18. Housing exit orifice is covered with a split plastic restrictor 42 made of such material as neoprene.

In operation, as the projectile 44 exits the muzzle barrel 18, it passes through the housing 10 and through the piston 26, and then out through the split neoprene restrictor 42. As the gases enter the housing 10 and expand, the increase of pressure in the housing 10 causes the piston 26 to move toward the housing front end 12 and in so doing compresses piston return spring 28. As the piston 26 moves, the piston orifices 36 and 38, which were concentric to the housing exit orifice 40, move with respect to the exit opening 40. With the projectile exit 40 now sealed, the muzzle blast gases are now contained in a pressurized, vented housing. The muzzle blast gases are bled off at a controlled rate through release valve 30, which reduces the blast noise by changing the gases exiting frequency to an inaudible frequency range. Concurrently, the impulse of the gases acting against the housing rear end 16, through piston open end 25, in opposition to the impulse acting against the piston closed end 24, acts as a barrel compensator, thus improving firing accuracy. Piston energy upon final stroke imparts energy opposite to the force acting against housing rear end 16, thus aiding in returning the weapon bore into target alignment. The device thus offers quick response to target re-engagement. The return spring 28 forces the piston 26 fron its "closed" position back into the "open" position after the pressure in the piston decreases to the point where the spring force overcomes the gas pressure.

Since all of the hot gases do not mix with the air immediately, only a minimal flash is produced. Because relief valve 20 is adjustable by calibrated adjustment screw 46, and because piston 26 weight and spring 28 strength can be varied, the device can compensate for lot to lot impulse variations, changes in weapon caliber and environmental conditions.

While there has been described and illustrated specific embodiments of the invntion, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A small arms silencer for reducing the muzzle blast gas flash and barrel compensation which comprises:

a "T" shaped hollow tubular housing having a partially closed front end, a partially closed rear end, and a tubularly shaped transversely positioned integral middle muzzle member which slidably fits on a muzzle barrel, the wall of said tubular housing having an exit orifice therein axially aligned with said muzzle member and said muzzle barrel, said wall having a longitudinally positioned keyway groove therein;

a split plastic restrictor fixedly positioned in said exit orifice;

an adjustable relief valve fixedly positioned in the front end of said housing;

means for releasing said muzzle blast gas from said housing at a frequency which is inaudible, said means being fixedly attached to the rear end of said housing and which communicates therewith;

piston means slidably positioned in said housing for allowing a projectile to pass through said piston means and said housing when said means is in an "open" position, for closing off said exit orifice of said housing after said projectile has passed through said housing, for providing barrel compensation, and for blocking the view of said muzzle blast gas flash; and spring means for returning said piston means from a "closed" position to said "open" position to permit use of said silencer on a rapid automatic fire weapon.

2. A small arms silencer as recited in claim 1 wherein said means for releasing blast gases comprises a gas release valve which produces sound waves at a frequency higher than 15,000 cycles/second.

3. A small arms silencer as recited in claim 1 wherein said piston means comprises a hollow tubularly shaped piston member having a closed end and an open end, said piston member having a pair of diametrically positioned piston orifices therein, said piston member having an integral longitudinally positioned alignment key thereon, wherein said key slidably engages said keyway groove.

4. A small arms silencer as recited in claim 1 wherein said spring means comprises a biased helical spring.

* * * * *